US008726614B2

(12) United States Patent
Donnellan et al.

(10) Patent No.: US 8,726,614 B2
(45) Date of Patent: May 20, 2014

(54) COMPOSITE MATERIAL STRUCTURE AND METHOD FOR MAKING SAME

(75) Inventors: Nuala Donnellan, O'Callaghans Mills (IE); John Reginald Newton, Grange over Sands (GB)

(73) Assignee: TB Composites Limited (IE)

( * ) Notice: Subject to any disclaimer, the term of this patent is extended or adjusted under 35 U.S.C. 154(b) by 733 days.

(21) Appl. No.: 12/063,327

(22) PCT Filed: Aug. 21, 2006

(86) PCT No.: PCT/IE2006/000089
§ 371 (c)(1), (2), (4) Date: Feb. 11, 2008

(87) PCT Pub. No.: WO2007/020618
PCT Pub. Date: Feb. 22, 2007

(65) Prior Publication Data

US 2010/0043305 A1 Feb. 25, 2010

Related U.S. Application Data

(60) Provisional application No. 60/791,349, filed on Apr. 12, 2006.

(30) Foreign Application Priority Data

Aug. 19, 2005 (IE) ..... S2005/0552

(51) Int. Cl.
*E04C 2/38* (2006.01)

(52) U.S. Cl.
USPC ..... 52/799.13; 52/653.1

(58) Field of Classification Search
CPC ..... E04B 2/763; E04C 2/388; E04C 2/38; E04C 2/425
USPC ..... 52/653.1, 799.11–799.14
See application file for complete search history.

(56) References Cited

U.S. PATENT DOCUMENTS

| | | | | |
|---|---|---|---|---|
| 2,511,620 | A * | 6/1950 | Clements | 49/503 |
| 2,593,714 | A * | 4/1952 | Robinson | 156/156 |
| 3,113,532 | A * | 12/1963 | White | 108/51.3 |

(Continued)

FOREIGN PATENT DOCUMENTS

| | | |
|---|---|---|
| EP | 0 147 050 | 7/1985 |
| GB | 2066308 | 7/1981 |
| JP | 11 061868 | 3/1999 |
| WO | WO 89/00495 | 1/1989 |

OTHER PUBLICATIONS

International Search Report and Written Opinion in English dated Mar. 20, 2007, issued in corresponding PCT Application No. PCT/IE2006/000089 filed Aug. 21, 2006.

*Primary Examiner* — Elizabeth A Plummer
(74) *Attorney, Agent, or Firm* — Ostrolenk Faber LLP

(57) ABSTRACT

The invention provides a composite material structure comprising a plate having an upper side, an under side and at least first and second beams, each beam having a plurality of faces comprising at least an upper face and a base face and a pair of spaced apart side faces intermediate to and adjoining the upper and base faces, each beam being attached to the underside of the plate at the upper face wherein the first beam has an open ended passage extending between the side faces and the second beam extends through the open ended passage.

15 Claims, 6 Drawing Sheets

(56) References Cited

U.S. PATENT DOCUMENTS

| | | | | | |
|---|---|---|---|---|---|
| 3,574,103 | A | * | 4/1971 | Latkin | 428/72 |
| 3,815,876 | A | * | 6/1974 | Saez | 256/22 |
| 3,819,143 | A | * | 6/1974 | Butts et al. | 249/33 |
| 3,913,154 | A | * | 10/1975 | Sweeney | 5/186.1 |
| 3,920,347 | A | | 11/1975 | Sauriol et al. | |
| 3,995,081 | A | * | 11/1976 | Fant et al. | 428/119 |
| 4,662,777 | A | * | 5/1987 | Newton | 404/25 |
| 5,344,601 | A | * | 9/1994 | Newton | 264/255 |
| 5,487,345 | A | * | 1/1996 | Winebarger et al. | 108/51.3 |
| 5,529,431 | A | * | 6/1996 | Walsh | 404/25 |
| 5,555,699 | A | * | 9/1996 | Borthick et al. | 52/801.11 |
| 5,855,984 | A | * | 1/1999 | Newton | 428/118 |
| 5,901,524 | A | * | 5/1999 | Wright | 52/668 |
| 6,464,425 | B1 | * | 10/2002 | Closkey | 404/26 |
| 6,649,006 | B2 | * | 11/2003 | Benson et al. | 156/245 |
| 6,656,405 | B1 | * | 12/2003 | Debergh | 264/258 |
| 6,740,381 | B2 | * | 5/2004 | Day et al. | 428/56 |
| 7,159,822 | B2 | * | 1/2007 | Grantham et al. | 244/119 |
| 7,828,329 | B2 | * | 11/2010 | Biscan | 280/781 |
| 7,905,183 | B2 | * | 3/2011 | Gibson et al. | 108/51.3 |
| 8,042,315 | B2 | * | 10/2011 | Ashton et al. | 52/783.19 |
| 8,042,767 | B2 | * | 10/2011 | Velicki et al. | 244/117 R |
| 2004/0009338 | A1 | * | 1/2004 | Jo et al. | 428/297.4 |
| 2008/0163573 | A1 | * | 7/2008 | Wendelburg et al. | 52/262 |
| 2010/0024964 | A1 | * | 2/2010 | Ingram et al. | 156/189 |

* cited by examiner

COMPOSITE MATERIAL STRUCTURE AND METHOD FOR MAKING SAME

CROSS REFERENCE TO RELATED APPLICATIONS

The present application is a 35 U.S.C. §§371 national phase conversion of PCT/IE2006/000089, filed Aug. 21, 2006, which claims priority of Irish Patent Application No. S2005/0552 filed Aug. 19, 2005, which is a non-provisional of U.S. provisional application 60/791,349 filed Apr. 12, 2006, the disclosures of which have been incorporated herein by reference. The PCT International Application was published in the English language.

FIELD OF THE INVENTION

The invention relates to a composite material structure and more particularly but not limited thereto an access cover made from the composite material structure.

BACKGROUND

Access covers such as manhole covers are structures that are subjected to high loads during their use, and historically these structures have been made of steel or cast iron. Metal manhole covers are known to be heavy and awkward to handle. Often load bearing structures were made using various casting methods. The metal in a finished article produced by one of these methods has isotropic properties unless the metal has been subjected to some form of processing via physical treatment, such as for example, forging to create directional properties. However, in the vast majority of cases no processing is applied to the metal structure. Therefore, the isotropic properties of the metal being used are normally taken into consideration in the design of the load bearing structures.

FIG. 1 shows a typical reinforcing structure on the underside of a prior art metal manhole cover. It comprises a single beam 6 welded to the underside of a top plate 7. Four small beams 8 have also been welded to the top plate 7 with one end of each small beam 8 welded to one of the two longitudinal sides of the single beam 6. The single beam 6 carries most of the bending stress imposed by any load applied to the manhole cover. The four smaller beams 8 function as cross-beams and transfer the load from a first smaller beam 8 at one longitudinal side of the beam 6 to a second smaller beam 8 at the opposing longitudinal side. This is carried out via the single beam 6 which links the two opposing smaller beams 8.

In such a structure, if it is made for example from structural mild steel, e.g. hot rolled steel grade 4 (HR4), the material would have a yield tensile strength of 175 $MN/M^2$. The bending stresses resulting from any load applied to the top plate 7 would produce in the single beam 6 on its outside face 6*a* tensile stresses in the direction of the length of the single beam 6. In the same manner the four smaller beams 8 would also be subject to tensile stresses in their longitudinal direction. The smaller beams 8 would also induce tensile stresses in the single beam 6 in the direction across the beam 6. Since the material is isotropic, tensile strength of the material on the outside surface 6*a* of the single beam 6 in the direction across the beam is the same as in its longitudinal direction, i.e. 175 $MN/M^2$. In general, the access cover material is capable of accepting stresses determined by the design of the structure taking into account isotropic properties of the material.

Fibre composites have three inherent advantages compared to metal. They are light weight, possess low values of thermal conductivity and have high values of electrical resistance. In the access cover manufacturing industry there are well defined requirements for one or more of these characteristics.

Within the last twenty years fibre composites have been used successfully for the manufacture of manhole covers. Composite manhole covers are described in the specification of EP 0147050 B1. That invention provides a structure consisting of inner and outer skins separated by webs. The skins and the webs are made from fibre reinforced plastics material. The structure is closed at the edges and spaces between the webs are filled with a plastics foam material. The fibre structure within the webs has been further improved by the application of a three dimensional weaving technique disclosed in GB 2066308 (Cambridge Consultants Limited). The process of manufacturing such manhole covers is described in the specification of EP 0365579 B1.

Composite materials of the type made of long continuous fibre of typically glass or carbon and arranged into a specific construction within a matrix resin can be organized to have specific properties in specified directions. For example a beam made of glass fibre composite can have tensile properties of 500 $MN/m^2$ in longitudinal direction and 150 $MN/m^2$ in lateral direction. These values are influenced by the amount of fibre placed in any specific direction (the fibre architecture) as well as by the Fibre Volume Fraction (FVF) and the particular construction of the fibre. FVF indicates the quantity of fibre in a given volume, and the greater the amount of fibre, the higher the material performance achieved. High performance composites typically have an FVF from 50% to 60%. Fibres are arranged into a usable construction by weaving or stitch bonding. The construction influences the final performance of the composite material, although its influence is less than the influence from the fibre architecture or FVF. Because of their high tensile strength value, composite material have the advantage in that less material is required to manufacture a load bearing structure.

If composite materials were used to manufacture the manhole top of FIG. 1, the tensile strength along the length of the single beam 6 could reach 500 $MN/m^2$. The same tensile strength could be achieved for the four small beams 8 in their longitudinal directions. As the single beam 6 is usually designed with a high value tensile strength in the longitudinal direction, the tensile strength in the direction across the single beam 6 i.e. perpendicular to the longitudinal direction would be reduced. At best the value that could be achieved would be typically 150 $MN/m^2$. In use the two small beams 8 adjacent each longitudinal side of the single beam 6 transfer their loads to each other across the single beam 6. The single beam 6 has a significantly lower tensile strength value than the small beams 8 in the same direction. Therefore the problem associated with this kind of structure is that the regions of the single beam 6 between the ends of each pair of smaller beams 8 attached to the opposing longitudinal sides of the single beam 6 represent areas of weakness in the reinforcing structure. Additional structure/beams would be required to overcome this weakness.

Some manhole covers are used to cover access to steam, hot air or hot water pipelines. There are requirements for such manhole covers and similar load bearing structures to provide venting in the form of holes in their structure. This is impractical in the described above skin/web composite structure currently in extensive use. The alternative approach used in the prior art is to configure a conventional metal manhole cover in the form of a plate and provide a load bearing structure below it, where the venting can be provided in the areas of the plate that do not contain the load bearing structure.

SUMMARY OF THE INVENTION

This invention seeks to alleviate and mitigate the above problems and to provide a composite material structure having a configuration which has an efficient reinforcing structure whilst simultaneously satisfying requirements for weight, thermal conductivity and electrical resistance and optionally providing for venting apertures on an access cover.

Accordingly, the invention provides a composite material structure comprising a plate having an upper side, an under side and at least first and second beams, each beam having a plurality of faces comprising at least an upper face and a base face and a pair of spaced apart side faces intermediate to and adjoining the upper and base faces, each beam being attached to the underside of the plate at the upper face wherein the first beam has an open ended passage extending between the side faces and the second beam extends through the open ended passage.

Such a structure enables each beam to act independently from the other when bearing loads.

Conveniently the composite material structure is not limited to two beams, it is possible to use any number of beams as determined by a person skilled in the art.

In a preferred arrangement, the passage and the second beam are mutually sized and shaped so that the upper face and the base face of the second beam are in abutment with corresponding surfaces defining the passage. Such an arrangement prevents the side faces of the first beam from losing strength due to removal of material in order to form the passage therein.

In a preferred embodiment, the composite material structure including the plate and beams is made of a composite material, such as glass or carbon fibre or the like. In a preferred arrangement, each of the beams comprise a tubular outer sheath made from the composite material. The interior of the sheath may be occupied by a core member for example a plastics foam. Each outer sheath comprises at least a base wall remote the underside of the plate and an upper wall adjacent the underside of the plate and a pair of spaced apart side walls. Preferably, the passage is formed in the first beam so that the upper wall and the base wall of the sheath of the second beam are in abutment with inner surfaces of the base wall and the upper wall of the sheath of the first beam.

In a preferred arrangement, each of the plate and the outer sheaths of the beams comprise fibres woven into a structure into which a matrix resin is infused thereby filling the voids between the fibres, subsequently the resin is cured to obtain a finished article. The fibres in the woven structure of each outer sheath are arranged to achieve tensile strength on the base wall of the sheath of up to 500 $MN/m^2$ in a longitudinal direction and up to or greater than 150 $MN/m^2$ in a lateral direction. Most preferably, about 72.5% of all the fibre forming the base wall extends in the longitudinal direction, about 22.5% extends in the lateral direction and about 5% extends in the direction perpendicular to the plane of the base wall. It will be appreciated that the above values may fluctuate within a range suitable in the circumstances. Ideally, each side wall of the outer sheath incorporates fibres extending at an angle of ±45° in the plane of the wall in relation to the longitudinal axis of the wall.

The beams may be attached to the underside of the plate by various means apparent to a person skilled in the art. In a preferred arrangement, some of the fibres of at least one of the beams, can be integrated into the woven fibre structure of the underside of the plate thus increasing the strength of the connection between the beam and the plate.

In another aspect, the invention provides a method for manufacturing a composite material structure comprising the steps of:

(a) providing a plate having an upper side and an under side;

(b) providing at least first and second beams, each beam having a plurality of faces comprising at least an upper face and a base face and a pair of spaced apart side faces intermediate to and adjoining the upper and base faces (c) forming an open ended passage in the first beam extending between the side faces of the first beam; and (d) attaching each beam to the underside of the plate at the upper face so that the second beam extends through the open ended passage in the first beam.

Preferably, the method further comprises the step of sizing and shaping the passage and the second beam so that upon placement of the second beam into the passage, the upper face and the base face of the second beam are in abutment with corresponding surfaces defining the passage.

Ideally, the method also comprises the step of forming the plate and the beams from a composite material, such as glass, carbon fibre or the like. Preferably each of the beams is formed having a tubular outer sheath made from composite material. Preferably, the method includes the further step of filling the interior of the sheath with a core member, for example a plastic foam.

In a preferred method, formation of the tubular outer sheath comprises arranging composite fibres so as to achieve tensile strength on the base wall of the sheath of up to 500 $MN/m^2$ in a longitudinal direction and up to or greater than 150 $MN/m^2$ in a lateral direction. Most preferably, the method comprises arranging about 72.5% of all the fibre forming the base wall to extend in the longitudinal direction, about 22.5% to extend in the lateral direction and about 5% to extend in the direction perpendicular to the plane of the base wall. Ideally, the method comprises arranging fibres in each side wall of the outer sheath to extend at an angle of ±45° in the plane of the wall in relation to the longitudinal axis of the wall.

Most preferably, the method comprises integrating some of the fibres of at least one of the beams into a fibre structure of the underside of the plate thus increasing the strength of the connection between the beam and the plate.

Ideally, the method includes the step of providing the open ended passage by forming an opening in each side wall of the outer sheath of a first beam and by forming a channel in the core member inside the outer sheath. Optionally, the openings are obtained by forming an "I"-shaped incision in each side wall the outer sheath prior to infusing matrix resin into the woven fibre structure. The "I"-shaped incision comprises a vertical slit extending substantially across the length of the side wall, preferably the length extends from the inner surface of the base wall to the inner surface of the upper wall. The vertical slit abuts a horizontal slit at each end of the vertical slit and the horizontal slits extend substantially perpendicular to the vertical slits. The vertical and the horizontal slits form a pair of flaps in the material of the longitudinal wall. The flaps are then bent inwardly to define the opening.

The present method further comprises placing the assembled plate and beams into a mould and infusing a matrix resin into the mould thereby filling the voids between the fibres. Advantageously, in the preferred method infusion of the matrix resin enables the flaps to integrate into the material of the side walls of the outer sheath of the second beam. Subsequently the resin is cured to obtain a finished article.

In another aspect, the invention provides a method for forming venting holes in a composite material made from woven fibre. In a single-layer woven fibre material, holes may be formed using a pointed tool to penetrate the fibres, thus parting the fibres in the location of penetration and creating a hole around the tool. In the plate of the composite material structure of the invention a tool may be used comprising a base and at least one pointed tool and preferably a series of such pointed tools. In order to create venting holes in the plate, a plurality of single-layer woven fibre sheets are placed one onto another in a pile on the base. Holes extending through the pile are created by displacing the fibre around the pointed tools. Matrix resin is then infused into the voids between the fibres and the parted fibres defining the holes are then fixed in position during the moulding process.

In a preferred embodiment, the composite material structure comprises a pair of first beams and a pair of second beams, each first beam comprises two passages for receiving the second beam, the passages being spaced apart from each other along the length of each first beam, and the passage of one first beam being in register with the corresponding passage on the other first beam. Each pair of the second beams extend perpendicularly through the passages on the first beams.

Preferably, the composite material structure comprises one or more venting holes formed according to the method as described above.

The preferred application of the above described composite material structure according to the invention is in an access cover, but not in any way limited thereto.

BRIEF DESCRIPTION OF THE FIGURES

The advantages of the present invention will become more apparent from the following description and accompanying drawings where.

DETAILED DESCRIPTION

Figure 1:
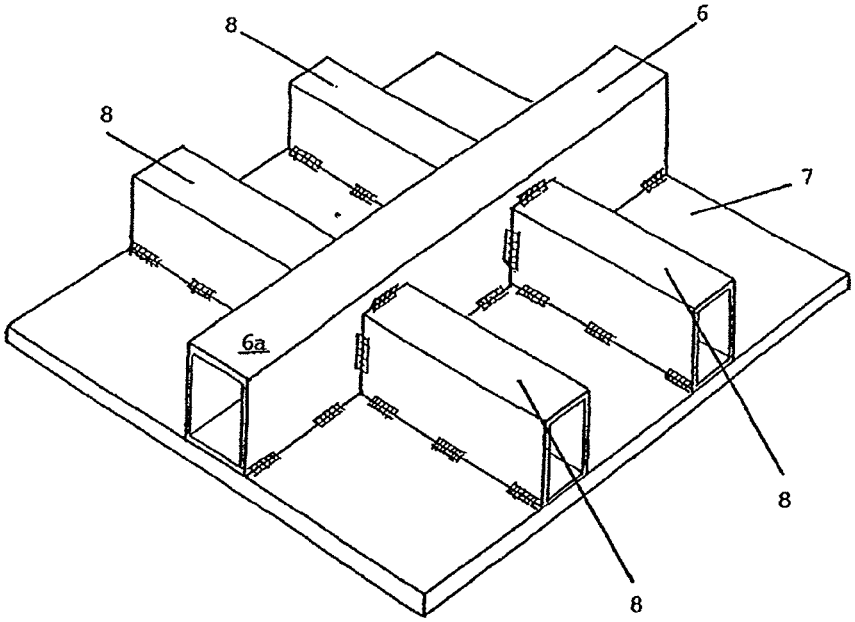
FIGURE 1 Prior Art
FIG. 1 is a perspective view of a three-beam structure on the underside of a prior art access cover.
Figure 2:
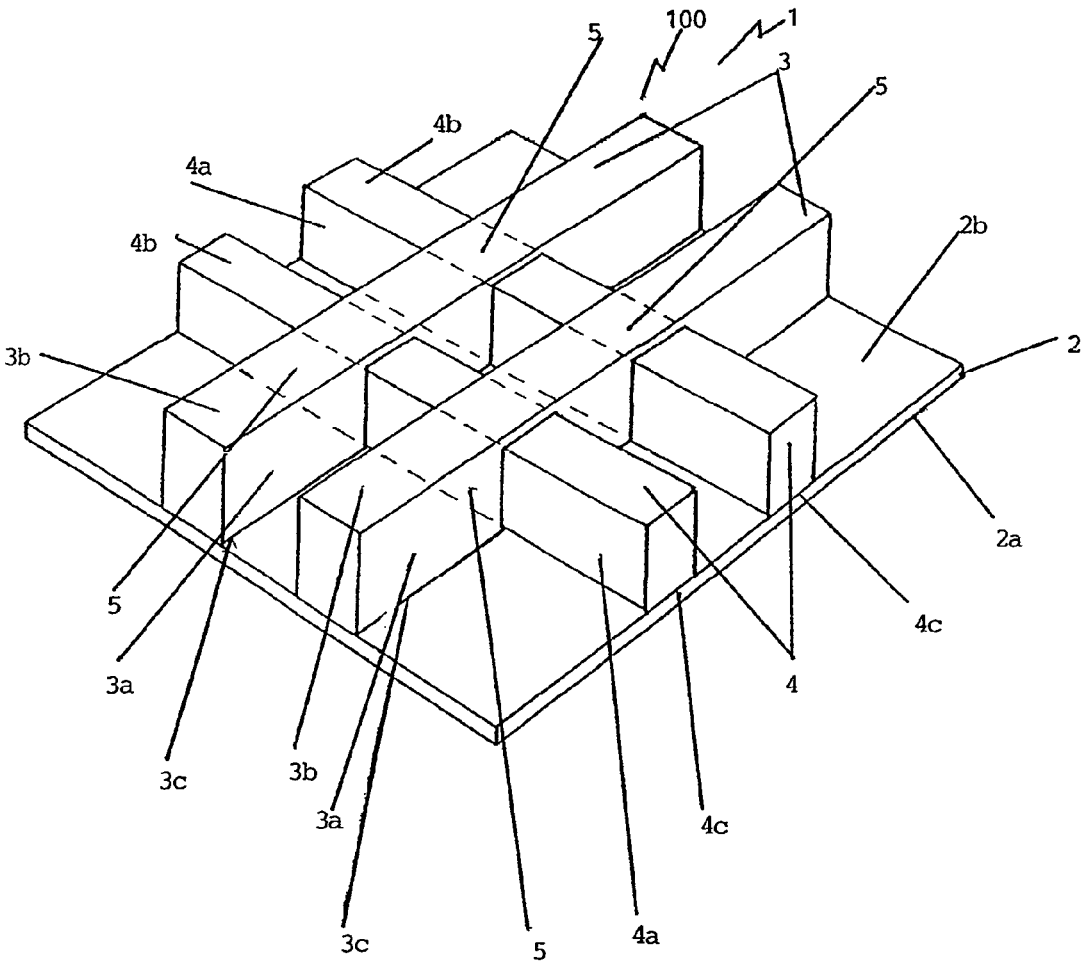
FIG. 2 is a perspective view of a through-beam structure on the underside of a access cover in accordance with the invention.

The access cover of FIG. 2 is indicated generally by reference numeral 1. The access cover 1 comprises a plate 2 having an upper side 2*a*, an underside 2*b* and a reinforcing beam structure 100 provided on the underside 2*b*. The reinforcing beam structure 100 comprises a pair of larger beams 3 extending across the underside 2*b* in one direction and a pair of smaller beams 4 extending substantially perpendicular to the larger beams 3. How the beams 3 and 4 are attached to the underside of the plate 2 is discussed below. Each larger beam 3 has a pair of side faces 3*a*, a base face 3*b* facing away from the underside 2*b* and an upper face 3*c*. Each smaller beam 4 has a pair of side faces 4*a*, a base face 4*b* and an upper face 4*c*. Passages are formed in the larger beams 3 enabling the smaller beams 4 to pass through the larger beams 3 as described below.

Figure 4:
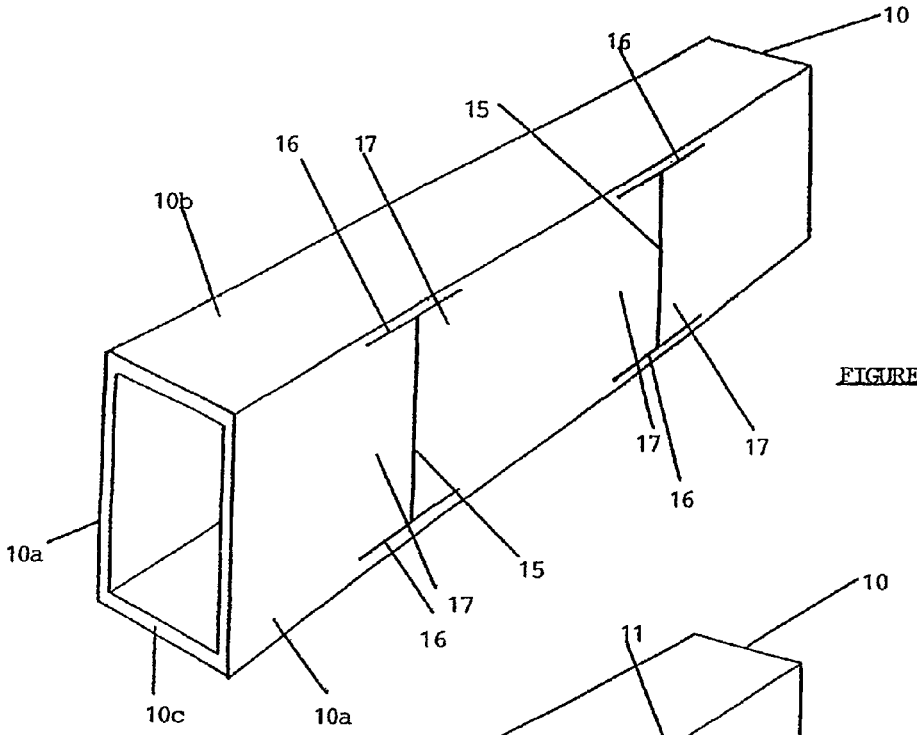
FIGS. 4 and 5 are perspective views of the outer sheath of a larger beam of the access cover in accordance with the invention illustrating how passages are formed transversely through the beam.
Figure 5:
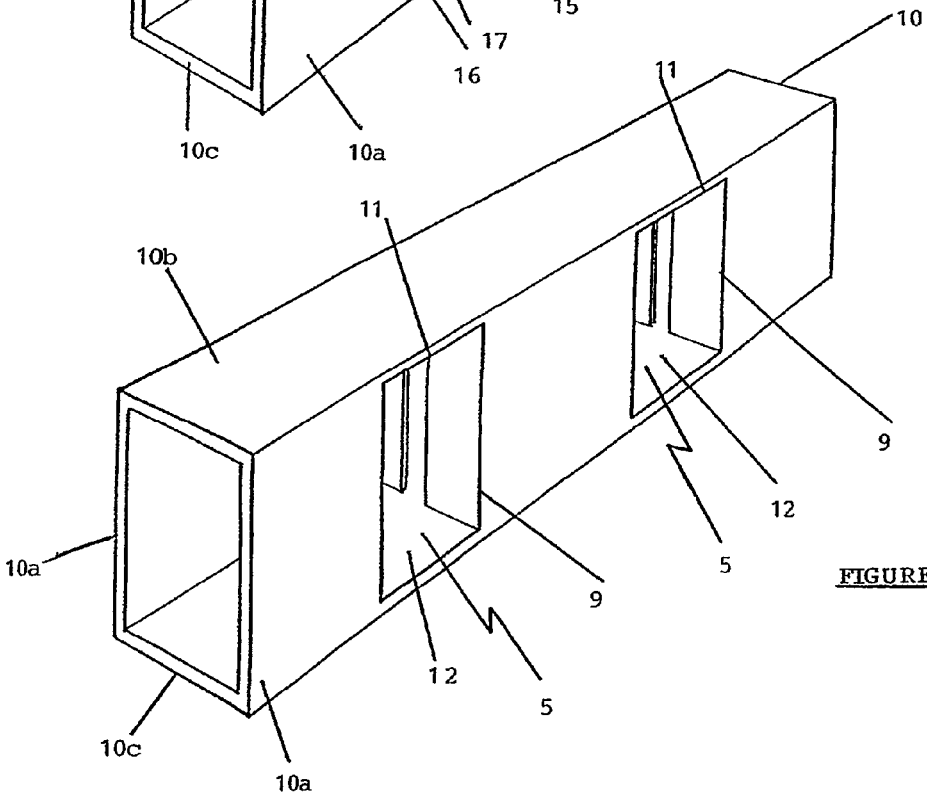

In the present embodiment, the access cover 1, including the beams 3 and 4 and the plate 2, is made from a composite material, such as glass or carbon fibre. Each of the beams 3 and 4, includes an outer sheath 10 (see FIG. 3) made from composite material and a core (not shown) made from foamed plastics material. The outer sheath 10 comprises a pair of side walls 10*a*, a base wall 10*b* and an upper wall 10*c*. The outer sheath 10 is obtained by forming a layer structure of reinforcing fibres, usually a structure of woven fibres, around a core, placing it into a mould and then injecting a liquid matrix resin into the mould to fill the voids between the fibres. The resin is then cured and the beams obtained by such a process have good mechanical properties and are low in weight. As shown in FIG. 4, the sheath 10 and, accordingly, the beams 3 and 4 have a rectangular cross-section in the present embodiment of the invention, but various cross-sections are possible within the scope of the invention. If the access cover 1 is to be used in a high temperature environment, such as for example in the proximity of steam, hot air or hot water pipeline, it is preferred to select a matrix resin having a high heat distortion The larger beams 3 extend substantially parallel to each other. A pair of open-ended passages 5 (see FIGS. 2 and 5) is formed transversely in the larger beams 3 for receiving the smaller beams 4. Each passage 5 extends from one side face 3*a* of the beam 3 to the other, and the two passages 5 of each larger beam 3 are spaced apart along the length of the beam 3. Each passage 5 in one larger beam 3 is in register with the corresponding passage in the other beam 3 thus enabling the smaller beam 4 to pass through the two larger beams 4. The passages 5 are provided by forming openings 9 (see FIG. 5) in the longitudinal walls 10*a* of the outer sheath of the larger beam 3 and forming a channel in the core inside the outer sheath 10 extending between the openings 9. The openings 9 can be formed by any suitable method apparent to a person skilled in the art. One example of a way of forming the passages 9 is illustrated in FIGS. 4 and 5. In order to form an opening 9, an "I"-shaped incision is formed in the woven fibre structure of the side wall 10*a* of the outer sheath 10 prior to moulding the matrix resin into the structure. The "I"-shaped incision comprises a vertical slit 15, which extends substantially across the side wall 10*a* from the inner surface 12 of the upper wall 10*c* to the inner surface 11 of the base wall 10*b*. The vertical slit 15 abuts a horizontal slit 16 at each free end of vertical slit 15, and the horizontal slits 16 extend substantially perpendicular to the vertical slit 15. The vertical slit 15 and the horizontal slits 16 define a pair of flaps 17. The flaps 17 are bent inwardly (FIG. 5) in order to enable insertion of a smaller beam 4 into the passage 5. During the moulding process, the material of the flaps 17 becomes part of the side faces 4*a* of the smaller beams 4 thus strengthening the larger beam 3 at the areas inside the beam 3 where the smaller beam 4 passes through it.

Thus, in the present embodiment, a first pair of opposing walls of each passage 5 is defined by the inner surfaces 11 and 12 of the base wall 10*b* and the upper wall 10*c*, respectively of the sheath 10. A second pair of opposing walls of the passage 5 is defined by surfaces (not shown) of the core inside the sheath 10. In the absence of a core inside the sheath 10, a passage 5 for a smaller beam 4 may be provided by just bending the flaps 17 inwardly, or indeed, by cutting out appropriate parts from the side walls 10*a* of the outer sheath 10 of the larger beam 3. In use, in the present embodiment, the base face 4*b* and the upper face 4*c* of the smaller beam 4 are in contact with the inner surfaces 11 and 12, respectively, of the outer sheath 10 of the larger beam 3. Thus, although voids are created in the larger beams 3 by forming the passages 5, the although voids are created in the larger beams 3 by forming the passages 5, the contacting surfaces of the smaller beams 4 and the larger beams 3 maintain strength of the longitudinal walls 3*a* of the larger beams 3.

It will be appreciated that the invention is not limited to the use of strictly four beams and indeed, it is possible to provide other structures having either more or less beams supporting the plate. Nor is the invention limited to a specific angle between the larger and smaller beams, which may be other than a substantially right angle. The shape of the beam in cross-section also is not limited to a rectangular cross-section and may vary suitably in the circumstances.

Figure 3:
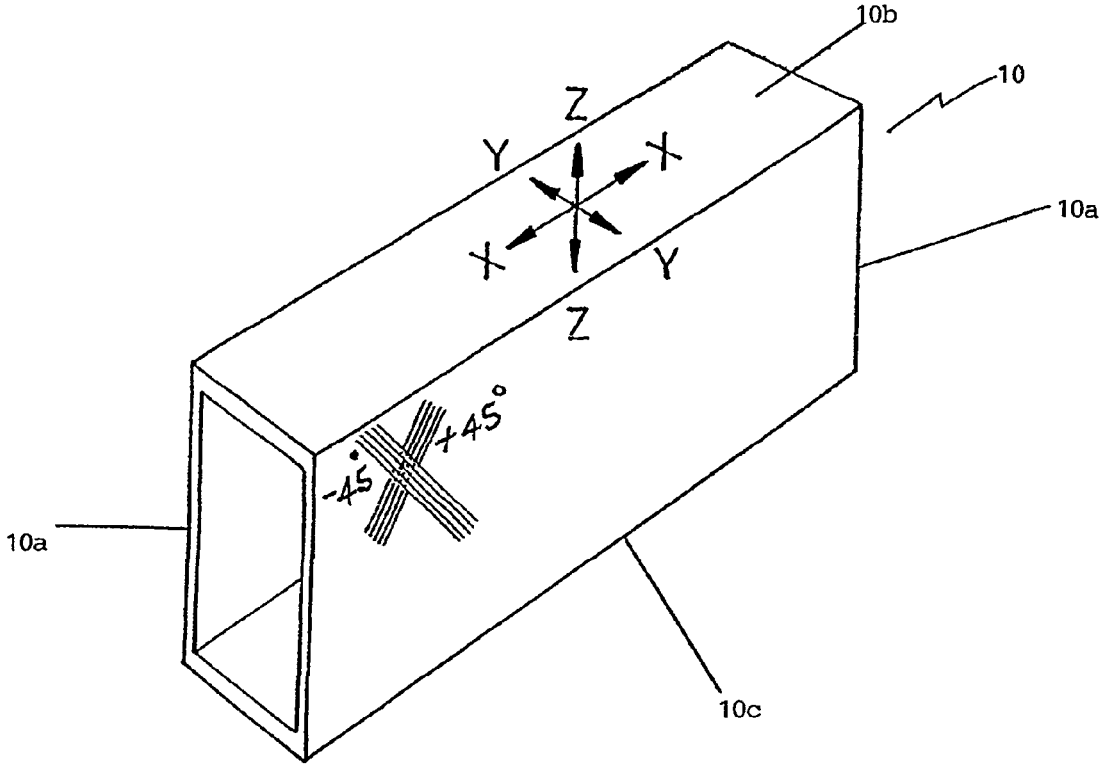
FIG. 3 is a perspective view of an outer sheath of a beam of the access cover of FIG. 2.

Fibre architecture of each large beam 3 on its outer face 3*b* is designed to provide the strength of 500 $MN/M^2$ in the longitudinal direction (direction X in FIG. 3), and 150 $MN/m^2$ in the lateral (direction Y in FIG. 3). Therefore, most of the fibres of the base walls 10*b*, typically about 72.5% of all the fibres present in the base wall 10*b*, extend in the direction X. About 22.5% of the fibres extend in the direction Y and the remaining fibres, typically about 5%, extend in the direction Z of FIG. 3. In use, the side faces 3*a* of the beam are subjected to shear stresses as opposed to bending stresses applied to the base face 3*b*. Therefore, as shown in FIG. 3, each side wall 10*a* of the outer sheath 10 of the beam 3 incorporates fibre extending at ±45° in relation to the X direction, and this orientation of the fibre provides optimum shear strength to the side face 3*a*. The same fibre architecture is present in the two smaller beams 4.

The beams 3 and 4 can be attached to the underside 2*b* of the manhole cover 1 by various methods apparent to the person skilled in the art. For example, the beams 3 and 4 can be laid onto the fibre structure which forms the underside 2*b* and then moulded into a finished product. In a more preferred arrangement, one pair of beams, for example, the pair of larger beams 3 can be integrated with the underside 2*b* in the same manner as described above, i.e. by moulding adjoining surfaces of the beams 3 and the underside 2*b*, whereas some of the fibre of the pair of smaller beams 4 can be integrated directly into the fibre structure forming the underside 2*b* and then moulded into a finished product. The latter arrangement increases strength of the connection between the beam structure and the plate 2 of the access cover 1.

The described above arrangement of an access cover, i.e. the provision of a plate 2 having a reinforcing beam structure on its underside provides regions in the plate 2 where venting apertures can be formed. In some countries there are regulations which limit the size of holes that may be used to provide venting and one such regulation limits the size of hole to 12.7 mm (½") in diameter in order to prevent heels of shoes becoming lodged in the venting hole. Conventional methods of making venting holes include drilling or casting holes in situ. However, because of the woven fibre structure of the presently described access cover 1 which determines its directional properties, the use of these methods would result in loss of integrity of the fibres and consequently to loss of strength of the plate 2 of the access cover and, therefore, are not suitable for such composite structures.

Figure 6:
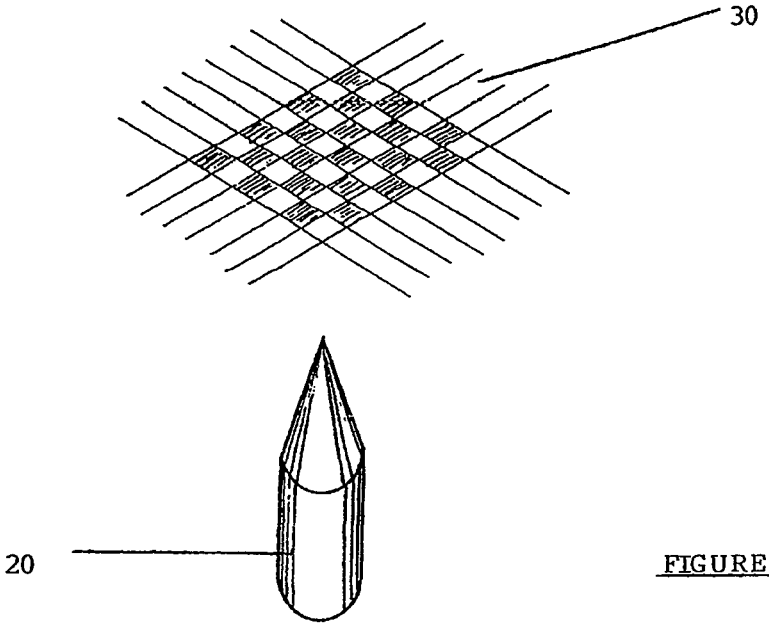
FIG. 6 is a perspective view showing a piece of single-layer fibre composite material and a pointed tool for forming an aperture in the material.
Figure 7:
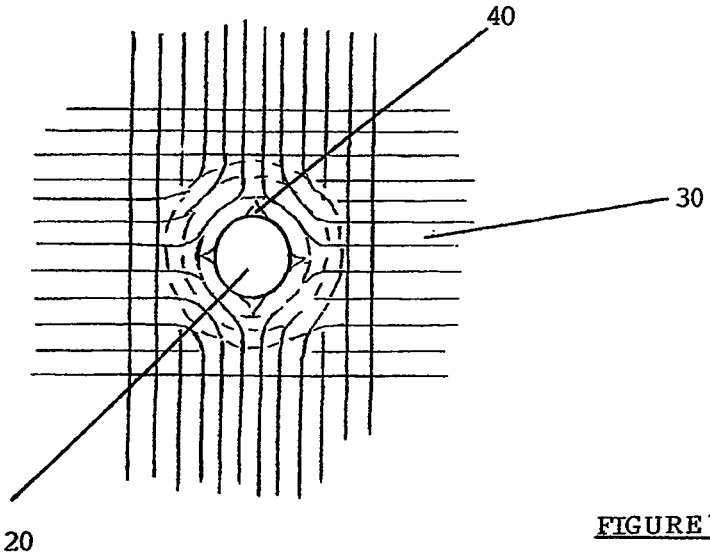
FIG. 7 is a plan view of the piece of composite material of FIG. 6 having a venting hole formed therein.

The present invention provides a method for forming holes in a composite material made from fibres arranged into a specific structure, e.g. woven structure. As shown in FIGS. 6 and 7, in the case of a typical single-layer material 30 made of woven fibres, a pointed tool 20 is used to penetrate the fibres of the material thus parting the fibres in the location of penetration around the pointed tool 20 and thus creating a hole 40 in the structure of the material 30.

Figure 8:
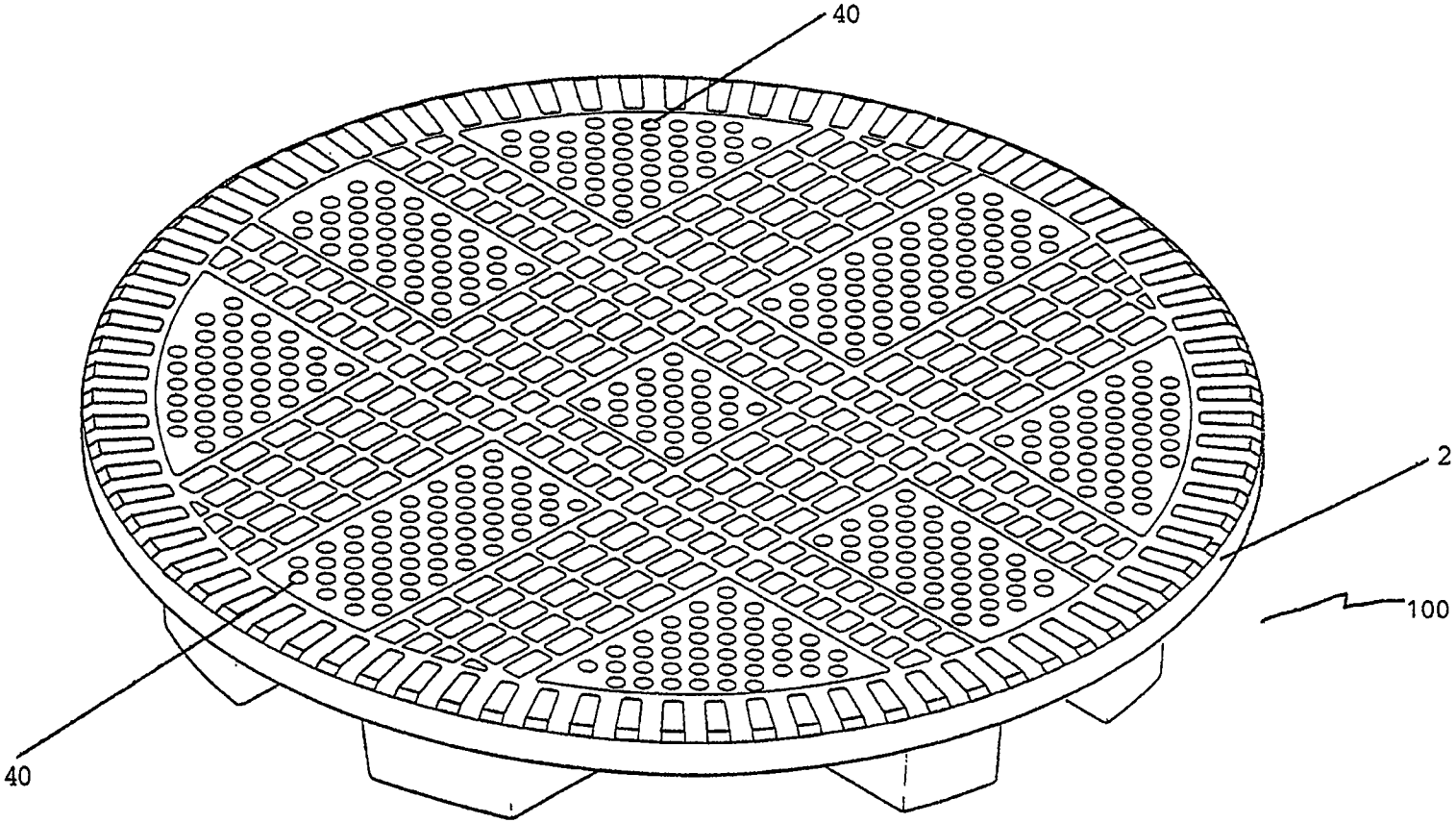
FIG. 8 is a perspective view of an access cover an application of the composite material structure of the invention.

By placing layers of such a single-layer woven fibre material onto a base (not shown) which is provided with one or more of such pointed tools 20, a laminate can be created containing multiple layers with one or more venting holes extending therethrough. For example only, multiple holes of the pattern shown in FIG. 8 can be achieved by this method in the access cover 100 of the invention.

The laminate with the preformed holes is then loaded into a mould and moulded into a finished article by the infusion of a matrix resin as described above. Material thickness around such holes in the axial direction of the holes will be increased due to accommodation of the fibres displaced in this direction by the hole-forming tool. Such an arrangement of the fibres also maintains the correct fibre volume fraction value (FVF). In order to achieve maximum performance from a composite, the fibres within the composites must be kept straight in certain locations, and displacing the fibres in order to make them pass around a hole reduces the strength of the final article.

Nevertheless, the amount of displacement created in a structure with hole sizes in the range of 12 to 13 mm and more specifically in the region of 12.7 mm is small compared to Nevertheless, the amount of displacement created in a structure with hole sizes in the range of 12 to 13 mm and more specifically in the region of 12.7 mm is small compared to the damage caused by drilling a hole in the structure and is therefore a more efficient method of forming holes.

It will be appreciated that the described below "through-beam" structure is not limited to the use with composite materials only, and can be applied to other suitable materials having directional properties or indeed, any other suitable materials regardless whether isotropic or anisotropic.

It is to be understood that the invention is not limited to the specific details described above which are given by way of example only and that various modifications and alterations are possible without departing from the scope of the invention as identified in the appended claims.

The invention claimed is:

1. A composite material structure comprising a plate having an upper side, an under side and at least first and second beams, the at least first and second beams each having a plurality of beam walls comprising at least an upper beam wall and a base beam wall and a pair of spaced apart beam side walls intermediate to and adjoining the at least upper and base beam walls defining a spacial area intermediate the plurality of beam walls, each of the at least first and second beams being attached to the under side of the plate at the at least upper beam wall, the at least first beam having an open ended passage extending between the at least pair of beam side walls, the at least second beam extending through the open ended passage and residing between and in contact with an inner surface of the at least upper beam wall and an inner surface of the at least base beam wall of the at least first beam, wherein the open ended passage and the at least second beam are sized and shaped so that the at least upper beam wall and the at least base beam wall of the at least second beam are in abutment with the inner surface of the at least upper beam wall and the inner surface of the at least base beam wall of the at least first beam respectively in the open ended passage, wherein the composite material structure comprises fibers woven into a woven structure into which a matrix resin is infused, wherein the at least first and second beams have load bearing properties in a longitudinal direction and a lateral direction, and wherein the at least first beam has the same load bearing properties in the longitudinal direction and the lateral direction as the at least second beam.

2. A composite material structure as claimed in claim 1, wherein each of the at least first and second beams comprises a tubular outer sheath.

3. A composite material structure as claimed in claim 2, wherein an interior of the tubular outer sheath is occupied by a core member.

4. A composite material structure as claimed in claim 2, wherein the fibers in the woven structure at each tubular outer sheath are arranged to achieve tensile strength on the at least base wall of the tubular outer sheath of up to 500 $MN/m^2$ in the longitudinal direction and up to or greater than 150 $MN/m^2$ in the lateral direction.

5. A composite material structure as claimed in claim 1, wherein some of the fibers form the at least first and second beams and are integrated into a woven fiber structure of the under side of the plate.

6. A composite material structure as claimed in claim 1, wherein the woven structure comprises one or more venting holes.

7. A method for manufacturing a composite material structure comprising the steps of:

(a) forming a plate having an upper side and an under side;

(b) forming at least first and second beams, the at least first and second beams each having a plurality of beam walls comprising at least an upper beam wall and a base beam wall and a pair of spaced apart beam side walls intermediate to and adjoining the at least upper and base beam walls;

(c) forming an open ended passage in the at least first beam extending between the at least beam side walls of the at least first beam, the open ended passage and the at least second beam being sized and shaped so that the at least second beam can pass through the open ended passage in the at least first beam while the at least upper beam wall of the at least second beam abuts an inner surface of the at least upper beam wall of the at least first beam inside the open ended passage and the at least base beam wall of the at least second beam abuts an inner surface of the at least base beam wall of the at least first beam inside the open ended passage; and (d) inserting the at least second beam through the open ended passage and between the at least upper beam wall and the at least base beam wall of the at least first beam such that the at least upper beam wall and the at least base beam wall of the at least second beam are in abutment with the inner surfaces of the at least upper beam wall and the at least base beam wall of the at least first beam respectively; and (e) attaching each of the at least first and second beams to the under side of the plate at the at least upper beam wall so that the at least second beam extends through the open ended passage in the at least first beam, wherein the composite material structure comprises fibers woven into a woven structure into which a matrix resin is infused; and wherein the at least first and second beams have load bearing properties in a longitudinal direction and a lateral direction, and wherein the at least first beam has the same load bearing properties in the longitudinal direction and the lateral direction as the at least second beam.

8. A method according to claim 7, wherein the method further comprises the step of forming each of the at least first and second beams such that the at least first and second beams comprise a tubular outer sheath made from composite material that includes structural fibers and resin.

9. A method according to claim 8, wherein the method includes the further step of filling an interior of the tubular outer sheath with a core member.

10. A method according to claim 8, wherein the method further comprises the step of filling an interior of the tubular outer sheath with a plastic foam.

11. A method according to claim 8, wherein the method further comprises the step of forming the tubular outer sheath such that the composite material comprises fibers woven so as to achieve tensile strength on the at least base wall of the tubular outer sheath of up to 500 $MN/m^2$ in the longitudinal direction and up to or greater than 150 $MN/m^2$ in the lateral direction.

12. A method according to claim 11, wherein the method further comprises the step of integrating some of fibers of at least one of the at least first and second beams into a fiber structure on the under side of the plate, thus increasing the strength of a connection between the at least first and second beams and the plate.

13. A method according to claim 11, further comprising placing an assembled plate and the at least first and second beams into a mold and infusing the matrix resin into the mold thereby filling voids between the fibers.

14. A method according to claim 9, including the step of providing the open ended passage by forming an opening in each of a side wall of the tubular outer sheath of the at least first beam and a channel in the core member inside the tubular outer sheath.

15. A method according to claim 7, further comprising the step of forming venting holes in the composite material structure made from fibers.

* * * * *

UNITED STATES PATENT AND TRADEMARK OFFICE

CERTIFICATE OF CORRECTION

PATENT NO. : 8,726,614 B2
APPLICATION NO. : 12/063327
DATED : May 20, 2014
INVENTOR(S) : Donnellan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 888 days.

Signed and Sealed this
Twenty-ninth Day of September, 2015

Michelle K. Lee

Michelle K. Lee
*Director of the United States Patent and Trademark Office*